US005619224A

United States Patent [19]

Hoshino et al.

[11] Patent Number: 5,619,224

[45] Date of Patent: Apr. 8, 1997

[54] LIQUID CRYSTAL DISPLAY PANEL DRIVING DEVICE

[75] Inventors: Masafumi Hoshino; Shuhei Yamamoto; Hiroyuki Fujita; Hirotomo Oniwa; Teruo Ebihara; Fujio Matsu, all of Chiba, Japan

[73] Assignee: Seiko Instruments Inc., Japan

[21] Appl. No.: 366,419

[22] Filed: Dec. 27, 1994

[30] Foreign Application Priority Data

Dec. 28, 1993 [JP] Japan ..... 5-335426

[51] Int. Cl.[6] ..... G09G 3/36

[52] U.S. Cl. ..... 345/98; 345/89; 345/94; 345/148

[58] Field of Search ..... 345/98, 87, 89, 345/94, 97, 147, 148, 149, 208; 348/671, 673, 790, 791, 792; 359/54, 55; 358/456, 459, 455

[56] References Cited

U.S. PATENT DOCUMENTS

| | | | |
|---|---|---|---|
| 5,122,791 | 6/1992 | Gibbons et al. | 345/102 |
| 5,459,495 | 10/1995 | Scheffer et al. | 345/89 |

FOREIGN PATENT DOCUMENTS

| | | |
|---|---|---|
| 0595495 | 5/1994 | European Pat. Off. . |
| 5100642 | 4/1993 | Japan . |
| 2014822 | 8/1979 | United Kingdom . |

OTHER PUBLICATIONS

Proceedings of the Twelfth International Display Research Conference Japan Display '92, Oct. 12–14, 1992 pp. 69–72, A.R. Conner et al., "Pulse–Height Modulation (PMH) Gray Shading Methods for Passive Matrix LCD's".

*Primary Examiner*—Kee M. Tung
*Assistant Examiner*—Doon Chow
*Attorney, Agent, or Firm*—Adams & Wilks

[57] ABSTRACT

In order to prevent signal distortion using a multiple line selection driving technique when using pulse width modulation to achieve a half-tone display in a liquid crystal display panel, respective bits of column signals are arranged in a descending pulse width order and a voltage generating circuit is used to lower level differences in adjacent bits. An orthonormal function generating circuit generates a plurality of row signals to drive a group of row electrodes through a vertical driver. A dot product computation circuit computes a dot product of the orthonormal functions and pixel display data to generate a column signal in the above manner. A horizontal driver applies the column signal to a group of column electrodes. Pixel data is stored in a frame memory, each datum being represented by a series of bits corresponding to a gray scale. The dot product computation circuit divides the pixel data into the respective bits, and individually carries out the dot product computation for each bit. The horizontal driver arranges the column signal components in order of descending pulse width. A voltage level circuit lowers the voltage level between the column components to reduce distortion caused by the high switching speed between the components and the low response time of the liquid crystal material.

20 Claims, 8 Drawing Sheets

FIG. 3

| GRADATION | FIRST BIT | SECOND BIT | THIRD BIT |
|---|---|---|---|
| 0 | 0 | 0 | 0 |
| 1 | 0 | 0 | 1 |
| 2 | 0 | 1 | 0 |
| 3 | 0 | 1 | 1 |
| 4 | 1 | 0 | 0 |
| 5 | 1 | 0 | 1 |
| 6 | 1 | 1 | 0 |
| 7 | 1 | 1 | 1 |

LIQUID CRYSTAL DISPLAY PANEL DRIVING DEVICE

BACKGROUND OF THE INVENTION

The present invention relates to a device for driving a plain, or matrix liquid crystal display panel using STN liquid crystal and so on the like. More specifically, the present invention relates to a driving device suitable for Multiple Line Selection addressing. Further specifically, the present invention relates to a structure of a driving circuit suitable for half tone display by Pulse Width Modulation (PWM).

A plain matrix type liquid crystal display panel is composed of a liquid crystal layer interposed between a group of row electrodes and a group of column electrodes thereby providing pixels arranged in a matrix. Conventionally, such liquid crystal display panels are driven by a Voltage Averaging Method. In this method, the respective row electrodes are sequentially selected one by one, and data signals representative of the ON/OFF status of pixels are applied to the column electrodes in synchronization with each timing to be selected.

Consequently, each pixel receives a high voltage of one time slot (1/N of a frame time interval) within one frame period during which all of (N number of) the row electrodes are selected, while the same pixel receives a constant bias voltage in the remaining time interval ((N−1)/N of the frame time interval). When the liquid crystal material has a slow response, there can be obtained a brightness corresponding to an effective value of the applied voltage waveform during one frame period. However, if a frame frequency is lowered as the multiplexing number increases, a difference between one frame period and a liquid crystal response time is reduced, so that the liquid crystal responds to each applied pulse to thereby cause a brightness flicker called "frame response" which degrades the contrast.

Recently, "Multiple Line Selection" has been proposed as means to deal with such a problem of the frame response, for instance, as disclosed in Japanese Tokkai Hei 5-100642. In this Multiple Line Selection technique, each of the row electrodes is not selected one by one as was conventional, but a plurality of row electrodes are simultaneously selected to equivalently achieve the same effect as the high frequency drive, thereby preventing the above-mentioned frame response. As its different from the single line selection driving technique, multiple line selection requires a specific technique for realizing a free display. Namely, it is necessary to arithmetically process an original image data and supply the processed data to a column electrode. Practically, a plurality of row signals represented by a set of orthonormal functions are applied to the group of row electrodes in sequence of the set of orthonormal functions during each selecting period. On the other hand, a dot product computation is carried out sequentially between the set of orthonormal functions and a set of selected pixel data, and then a column signal that has a voltage level corresponding to a result of the computation is applied to the group of column electrodes in synchronization with the set sequential scanning during each selecting period.

The above-mentioned Multiple Line Selection driving technique can be also adapted to a half tone display. There are a variety of methods for half tone display, especially the Pulse Width Modulation technique, which can be easily combined with the Multiple Line Selection, for instance, as disclosed also in the above-mentioned Japanese Tokkai Hei 5-100642. In this method, a given pixel data has a plurality of bits and gray shading is displayed therewith. When the dot product computation is carried out between the set of orthonormal functions and the set of pixel data, the set of pixel data is divided by the bits to carry out the computation and generate column signal components corresponding to significance of the bits. Further, the column signal components are arranged in an order of bit significance during each selecting period to compose a column signal, which is applied to a group of column electrodes, thereby obtaining a desired half tone display.

FIG. 9 shows an example of column signal according to the PWM gray-scale technique. In this example, a pixel data is composed of 4 bits and can be displayed in $2^4=16$ gray levels. Four column signal components A, B, C, and D are arranged in accordance with the significance of the respective bits during each of selecting periods Δt. A first column signal component A corresponds to a least significant bit, whose pulse width is represented by "1". A second column signal component B corresponds to a second least significant bit, whose pulse width is twice as large as that of the component A. A third column signal component C corresponds to a third least significant bit, whose pulse width is four times as large as that of the component A. A final column signal component D corresponds to a most significant bit, whose pulse width is eight times as large as that of the component A. Further, a voltage level of each column signal component is obtained by a dot product computation by the corresponding significance of each bit. An effective voltage during the selecting period Δt is obtained as a weighted mean value of the column signal components A to D. Further, the column signal component D corresponding to the most significant bit is the most dominant, while the column signal component A corresponding to the least significant bit makes the least contribution.

voltage levels of the column signal components A to D that are arranged as thus described are switched very swiftly during the selecting period Δt. Therefore, a waveform is distorted when the voltage level is switched, resulting in an error in the part hatched. As the difference between two adjacent voltage levels is increased, a degree of the distortion of the wavelength becomes larger. There is a problem that this error prevents accurate half-tone display. Especially, the error in column signal components corresponding to the more significant bits has more influence on fluctuation in half-tone display level compared with the error in those corresponding to the less significant bits. The example shown by FIG. 9 has a problem that the error in column signal components corresponding to the more significant bits is brought about according to voltage levels of the column signal components corresponding the less significant bits, resulting a large fluctuation finally.

SUMMARY OF THE INVENTION

In view of the above mentioned problems of the prior art, an object of the present invention is to prevent a decline in image quality in case of displaying half-tone by combining Multiple Line Selection and Pulse Width Modulation. In order to achieve this object and others, the invention takes the following two means. The inventive driving device basically drives a liquid crystal display panel in which a liquid crystal layer is held between a group of row electrodes and a group of column electrodes to provide pixels in matrix, according to given pixel data. The inventive driving device has a first means for applying a plurality of row signals represented by a set of orthonormal functions to the group of row electrodes by set sequential scanning for each of selecting periods. Further, the inventive driving device has a second means for carrying out dot product computation between the set of orthonormal functions and the set of selected pixel data, and applying a column signal that has a voltage level according to a result of the computation to the group of column electrodes in synchronization with the set sequential scanning for each of the selecting periods. The second means includes a frame memory for holding the pixel data with gray shading composed of a plurality of bits, and a dot product computing means for dividing the set of pixel data by the bits used for carrying out the dot product computation and generating column signal components corresponding to the significance of the respective bits.

A first feature of the invention is as follows. The second means further includes a particular driving means, which arranges the column signal components in the sequence from that of the most significant bit with a larger pulse width to the least significant bit in one selecting period to compose the column signal and applies the signal to the group of column electrodes.

A second feature of the invention is as follows. The second means includes a particular driving means, which arranges the column signal components corresponding to significance of the respective bits sequentially within one selecting period so as to compose each of the column signals, and lowers the voltage level to the predetermined reference potential once among the column signal component and applies the column signals to the group of column electrodes.

BRIEF DESCRIPTION OF THE DRAWINGS

FIG. 3 is a table chart showing a bit structure of the pixel data.

DETAILED DESCRIPTION OF THE PREFERRED EMBODIMENTS

Figure 9:
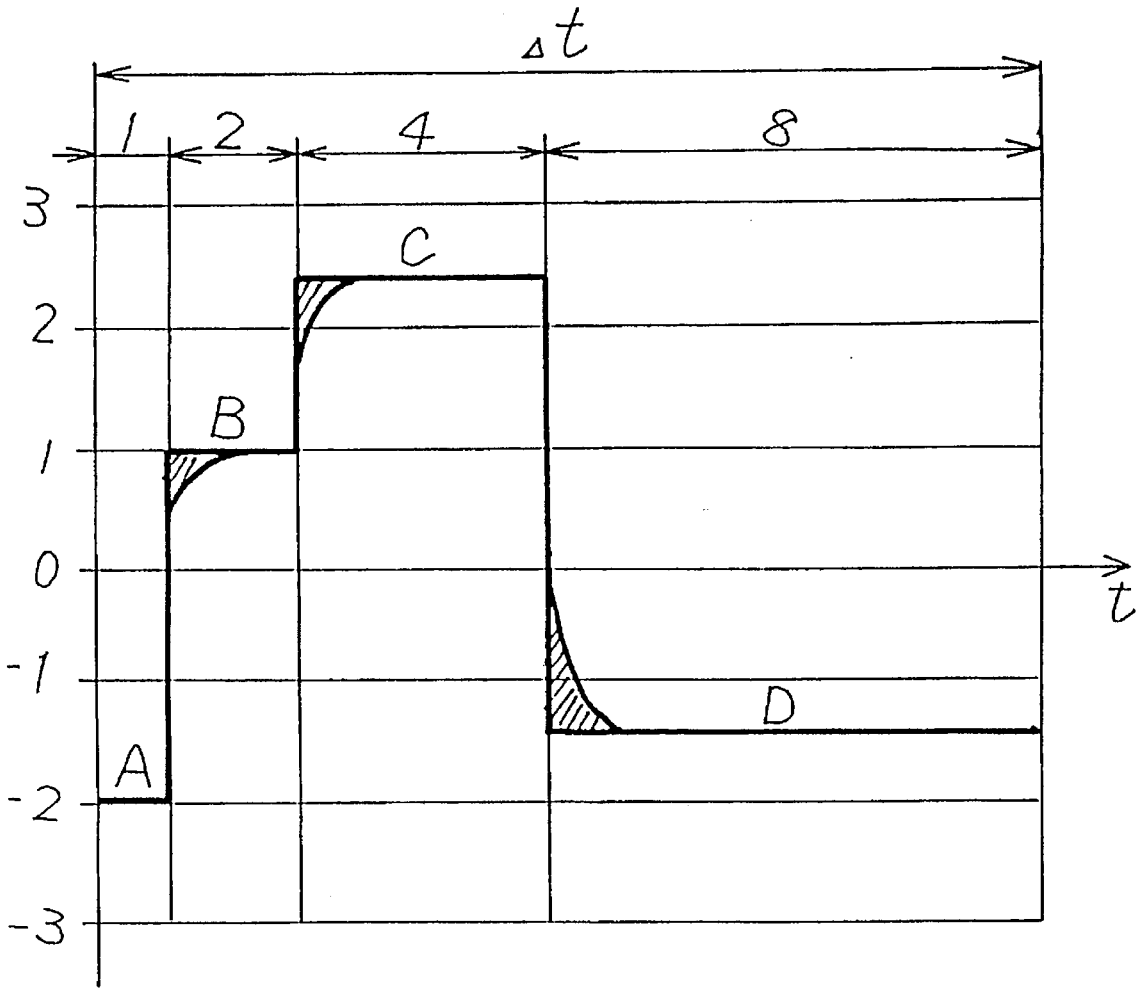
FIG. 9 PRIOR ART
FIG. 9 is a waveform showing a column signal waveform generated by the conventional Pulse Width Modulation.

According to the first feature of the invention, differently from the prior art shown in FIG. 9, the column signal components corresponding to the significance of the respective bits are arranged in the sequence from those of the most significant bit to those of the least significant bit. Therefore, the voltage level of the column signal components of the more significant bits causes the waveform of the column signal components of less significant bits to distort. In other words, the signal components making a large contribution to pixel density result in an error to the signal components making less of a contribution, so that it is possible to restrict fluctuation in pixel density more is compared with the prior art.

Further, according to the second feature of the invention, the voltage level of the column signal components is lowered to a predetermined reference potential, then it shifts to the next voltage level. As a result, the difference between two adjacent voltage levels is decreased on the average, and the distortion of the waveform of the column signal can be restricted more than in the prior art. Therefore, on the whole, it is possible to restrain fluctuation in pixel density, which was difficult in the prior art.

Hereinafter, preferred embodiments of the present invention will be explained in detail referring to the attached drawings.

Figure 1:
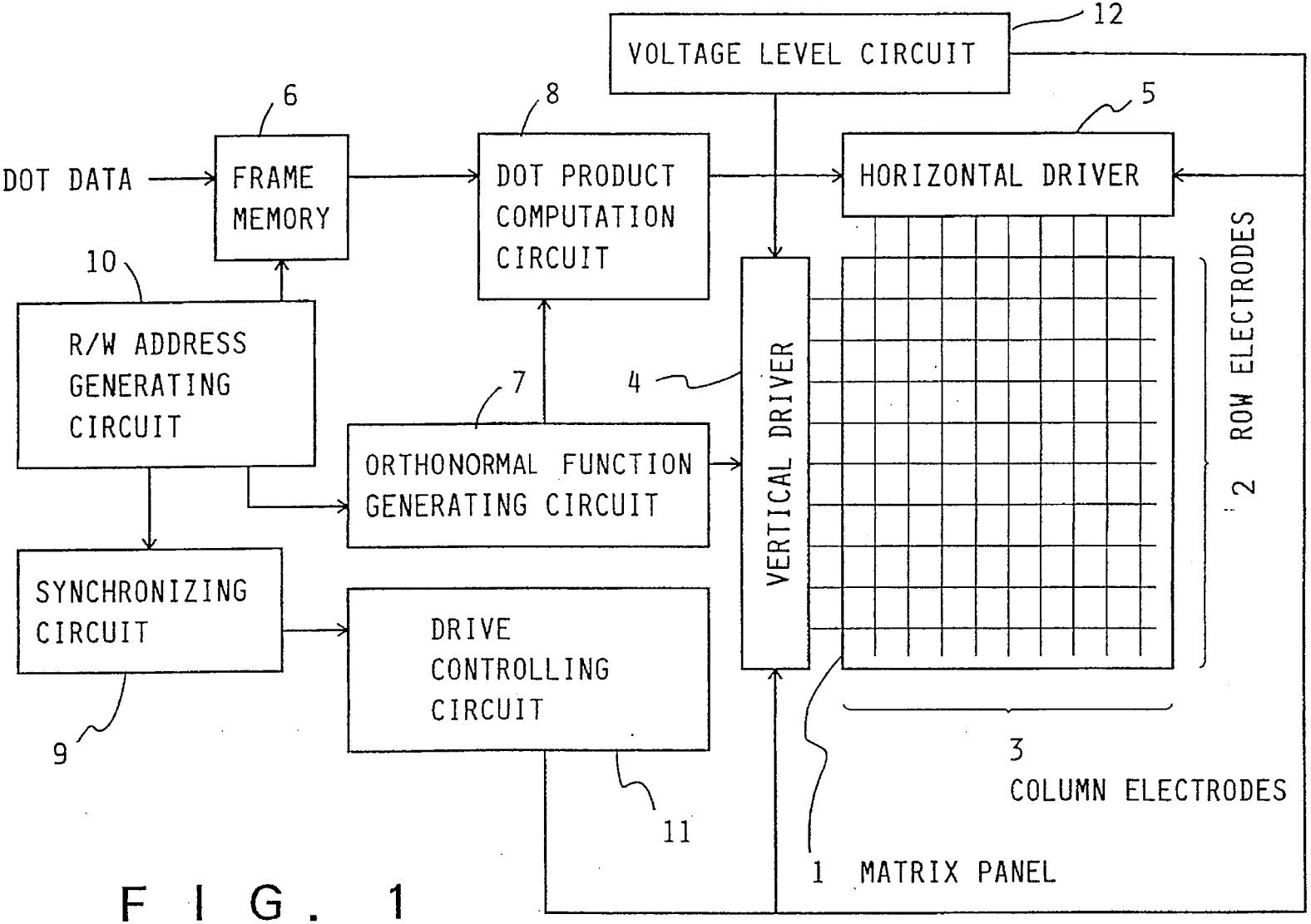
FIG. 1 is a block diagram showing a basic structure of an embodiment of the device for driving a liquid crystal display panel according to the present invention.

FIG. 1 is a schematic block diagram showing the inventive liquid crystal panel driving device. As shown in FIG. 1, the inventive driving device is connected with a plain matrix type liquid crystal panel 1. This liquid crystal display panel 1 has a flat panel structure in which that a liquid crystal layer is interposed between a group of row electrodes 2 and a group of column electrodes 3. STN liquid crystal, for example, can be used as the liquid crystal layer.

The driving device has a vertical driver 4 which is connected with the group of row electrodes 2 to drive them. The driving device has also a horizontal driver 5 which is connected with the group of column electrodes 3 to drive them. The driving device further has a frame memory 6, an orthonormal function generating circuit 7, and a dot product computing circuit 8. The frame memory 6 holds pixel data inputted in each frame. The pixel data represents density of pixels provided at cross sections of the group of row electrodes 2 and the group of column electrodes 3. In the present invention, the pixel data has a plurality of bits which enable pixel density to be displayed with gray shading. In this relation, the frame memory 6 has a bit plane corresponding to significance of each bit. In FIG. 1 a first bit plane corresponding to the most significant bit is shown on the top.

The orthonormal function generating circuit 7 generates a plurality of functions which are orthonormal to each other, and supplies sequentially the orthonormal functions in appropriate sets to the vertical driver 4. The vertical driver 4 applies a plurality of row signals represented by the sets of orthonormal functions to the group of row electrodes 2 by a set sequential scanning for each selecting period.

Therefore, the orthonormal function generating circuit 7 and the vertical driver 4 correspond to the above-mentioned first means.

The dot product computing circuit 8 carries out a predetermined dot product computation between a set of pixel data sequentially read out from the frame memory 6 and a set of orthonormal functions transferred from the orthonormal function generating circuit 7 and feeds a result of the computation to the horizontal driver 5. The horizontal driver 5 applies a column signal that has a voltage level according to the result of the dot product computation, to the group of column electrodes 3 in synchronization with the set sequential scanning for each selecting period. The voltage level necessary for composing the column signal is supplied from a voltage level circuit 12 in advance. Therefore, the horizontal driver 5 selects the voltage level according to the result of the dot product computation, and supplies it as the column signal to the group of column electrode 3. As understood from the above explanation, the frame memory 6, the dot product computing circuit 8, the horizontal driver 5, and the voltage level circuit 12 compose the above-mentioned second means. The voltage level circuit 12 supplies the predetermined voltage level also to the vertical driver 4. The vertical driver 4 sequentially selects a voltage level according to the orthonormal functions, and supplies it as the row signal to the group of row electrodes 2.

The present device has a synchronizing circuit 9, a R/W address generating circuit 10, and a drive controlling circuit 11 in addition to the above main elements. The synchronizing circuit 9 synchronizes a pixel data read timing from the frame memory 6 and signal transfer timing from the orthonormal function generating circuit 7. A desired image is displayed by repeating the set sequential scanning in a frame time interval. The R/W address generating circuit 10 controls read/write of pixel data into the frame memory 6 by each bit plane. The address generating circuit 10 is controlled by the synchronizing circuit 9, and supplies predetermined read out address signals to the frame memory 6. The drive controlling circuit 11 is controlled by the synchronizing circuit 9 and supplies a predetermined clock signal to the vertical driver 4 and the horizontal driver 5.

As mentioned above, in order to display gray shading of the pixel by Pulse Width Modulation, the frame memory 6 divides pixel data composed of a plurality of bits into each bit plane and holds them. When the above specific dot product computation is carried out between the set of orthonormal functions and the set of pixel data, the dot product computing circuit 8 divides the set of pixel data into the respective bits, and carries out the dot product computation to generate column signal components corresponding to significance of the respective bits. The horizontal driver 5 arranges the column signal components in an order from the column signal component corresponding to the most significant bit with a large pulse width to that corresponding to the least significant bit with a small pulse width during one selecting period to compose the column signal, and supplies them to the group of column electrodes 3. When the voltage level circuit 12 supplies a predetermined voltage level to the horizontal driver 5, the voltage level is once lowered to a predetermined reference potential among the column signal components.

Figure 2:
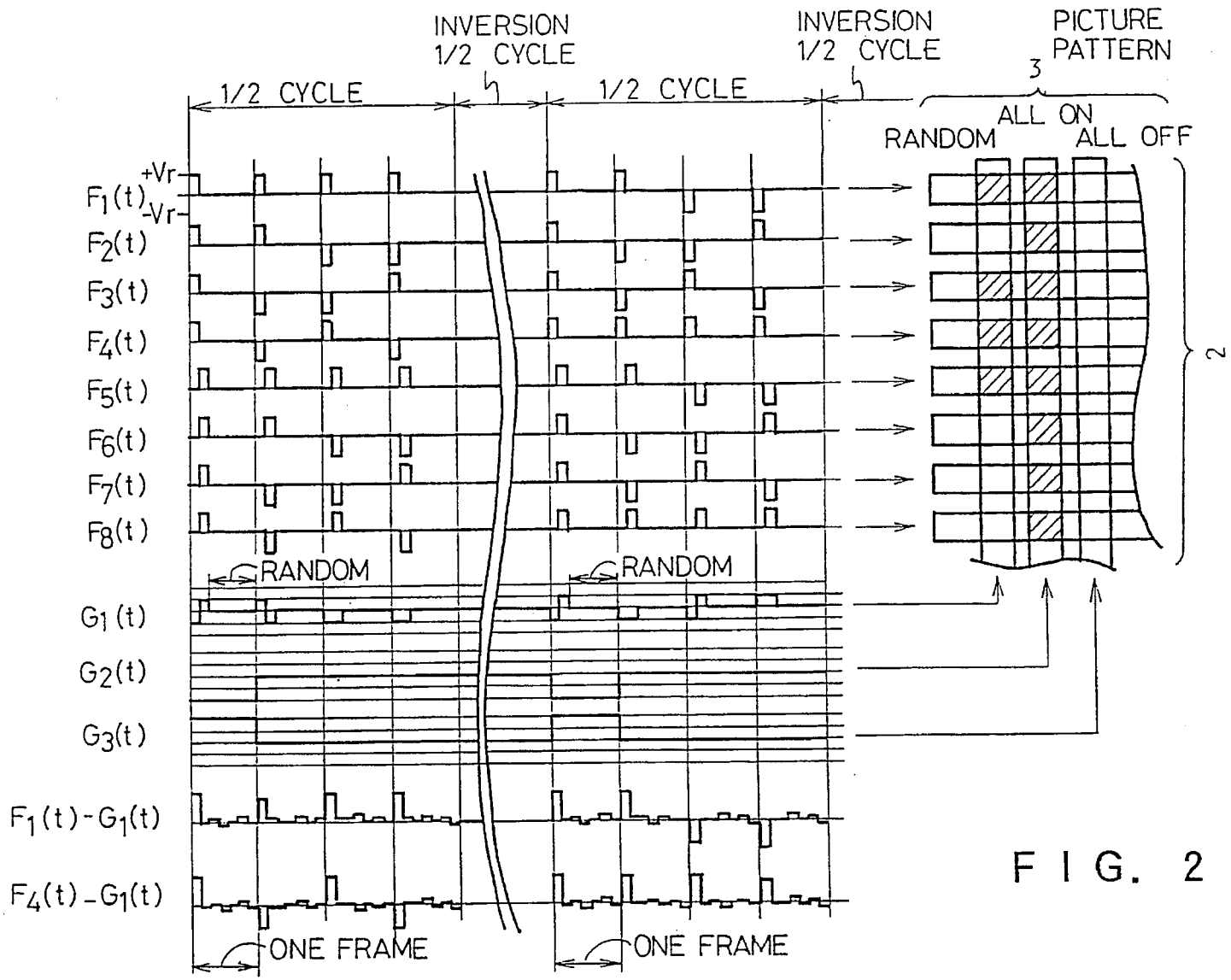
FIG. 2 is a waveform chart used to explain an operation of the device for driving a liquid crystal display panel shown in FIG. 1.

Hereinafter, description is given to the multiple line selection driving technique where seven lines of the row electrodes are concurrently selected. FIG. 2 shows a waveform of the seven line concurrent driving method. $F_1(t)$–$F_8(t)$ denote row signals applied to respective row electrodes. $G_1(t)$–$G_3(t)$ denote column signals applied to respective column electrodes. The row signal F is set according to a Walsh function which is one of the complete orthonormal functions in (0, 1). The scanning waveform is set to "–Vr" corresponding to "0", set to "+Vr" corresponding to "1", and set to $V_0$ during a nonselection periods. The voltage level $V_0$ for nonselecting period is set to "0 V". Seven lines are selected concurrently as a group such that each group is sequentially scanned from top to bottom of the display. Eight times of the group sequential scanning corresponds to one period of the Walsh function to complete a first half cycle. In the next period, a second half cycle is carried out while the polarity of the signal is inverted to thereby remove a DC component. In the next subsequent period, a combination pattern of the orthonormal functions is vertically rotated to compose row signals and the row signals are applied to the group of row electrodes 2. The vertical rotation is not necessarily required.

On the other hand, the column signal applied to the group of column electrodes are subjected to predetermine dot product computation in which each pixel data is Iij where "i" denotes a row number of the matrix, and "j" denotes a column number of the matrix. Supposing a case that a pixel data includes not a plurality of bits but a single bit, and that each dot data Iij is set to "–1" for the ON state pixel and set to "+1" for the OFF state pixel. Then, the column data signal Gj(t) applied to each signal electrode is basically set by carrying out the following dot product computation:

$$G_j(t) = \frac{1}{\sqrt{N}} \sum_{i=1}^{N} I_{ij} \times F_i(t)$$

In the above computation, the summation is effected only for the selected rows since the row signal is set to "0" level in the nonselection period. Accordingly, in the concurrent selection of the seven lines, the column signal can take eight voltage levels. Namely, the column signal requires a certain number of voltage levels equal to "concurrently selected line numbers +one". This potential level is supplied from the voltage level circuit 12 shown in FIG. 1 as mentioned above.

The above-mentioned dot product computation is applied to the pixel data having a single bit, and does not display gray shading. When the gray shading is displayed by the Pulse Width Modulation according to the present invention, each of the pixel data has a plurality of bits. The dot product computation in this case will be explained hereinafter. FIG. 3 shows a case in which pixel data having three bits is input to display half-tone with eight gray-levels. As shown in FIG. 3, each of the pixel data has a first bit corresponding to the most significant bit, a second bit corresponding to the bit with middle significance, and a third bit corresponding to the least significant bit. Each of the bits is binary, taking a value of 0(zero) or 1. When all the three bits of the pixel data are "0", the pixel data displays the lowest level, a zeroth level. When all the three bits are "1", the pixel data displays the highest level, a seventh level. A desired half tone can be displayed according to numbers taken by the respective bits. In order to carry out a dot product computation with regard to the pixel data having three bits, the pixel data are divided by the bits. In order words, first of all, the dot product computation is carried out between the set of first bits and the set of the orthonormal functions to generate the column signal component corresponding to the most significant bit. Next, the similar dot product computation is carried out between the set of second bits and the set of the orthonormal functions to generate the column signal component corresponding to the middle bit. Lastly, a similar dot product computation is carried out between the set of the third bits and the set of the orthonormal functions to generate the column signal component corresponding to the least significant bit.

Figure 4:
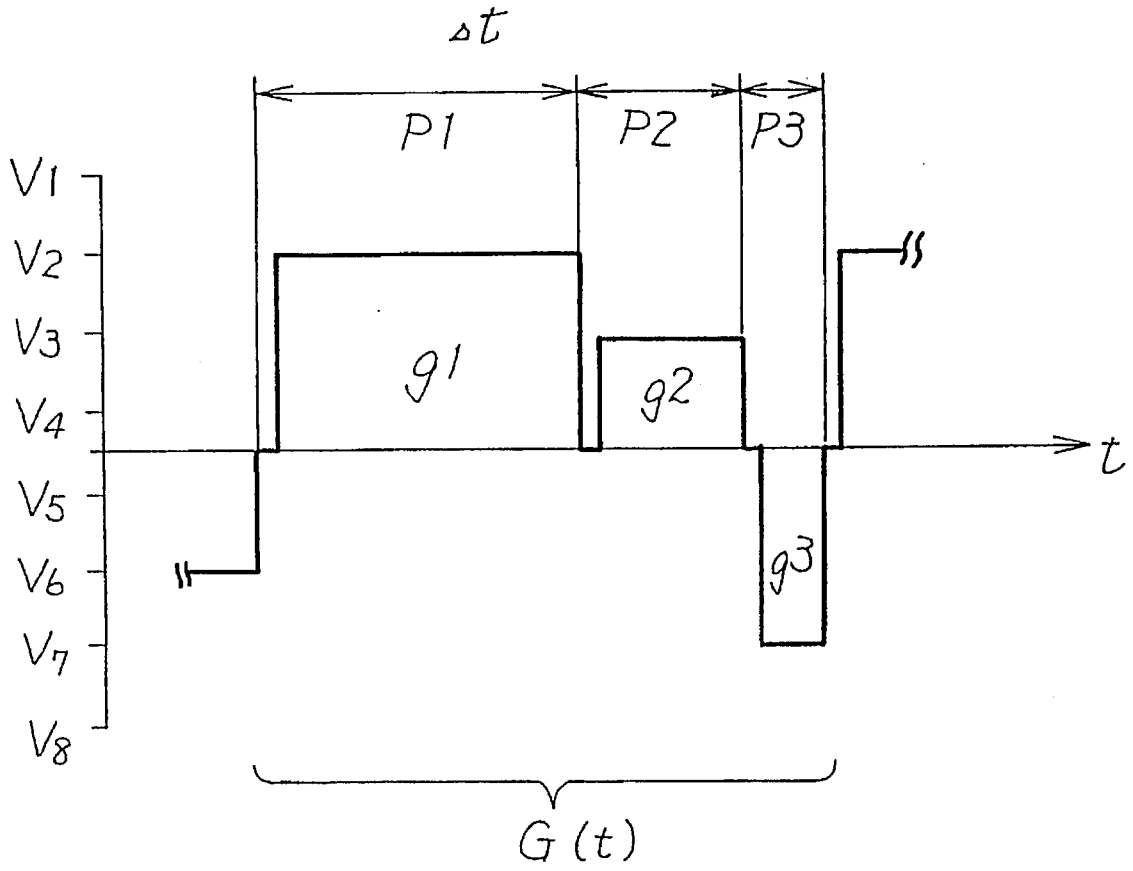
FIG. 4 is a waveform chart showing an example of the waveform of the column signal.

FIG. 4 shows an example in which column signal components that are generated in the abovedescribed manner are arranged to compose the column signal. In FIG. 4, a horizontal axis is denoted as a time t, and a vertical axis represents the voltage level of a column signal G(t). As mentioned above, the column signal G(t) takes one of eight voltage levels $V_1$ to $V_8$ according to a result of the dot product computation. The column signal G(t) includes three column signal components g1, g2 and g3 in one selecting period Δt according to the three bits included in the pixel data. The first column signal component g1 is obtained by the dot product computation by using the set of the first bits shown in FIG. 3, and corresponds to the most significant bit. Therefore, its pulse width P1 is the largest of all. The second column signal component g2 corresponds to the middle significant bit, whose pulse width P2 is half as large as P1.

The last column signal component g3 corresponds to the least significant bit, whose pulse width P3 is half as large as P2., An effective voltage of the column signal G(t) is represented by a total of the column signal components G1, G2 and G3, and desired half tone is displayed with those components. It is a feature of the present invention that the column signal components are arranged in an order from the most significant bit to the least significant bit, and are applied to the column electrodes in this order. Further, the column signal components are once lowered to a predetermined reference level, and then shift to the next voltage level. Therefore, a difference in potential between two adjacent voltage levels is decreased on average, thereby restraining distortion in wavelength of applied voltage.

Figure 5:
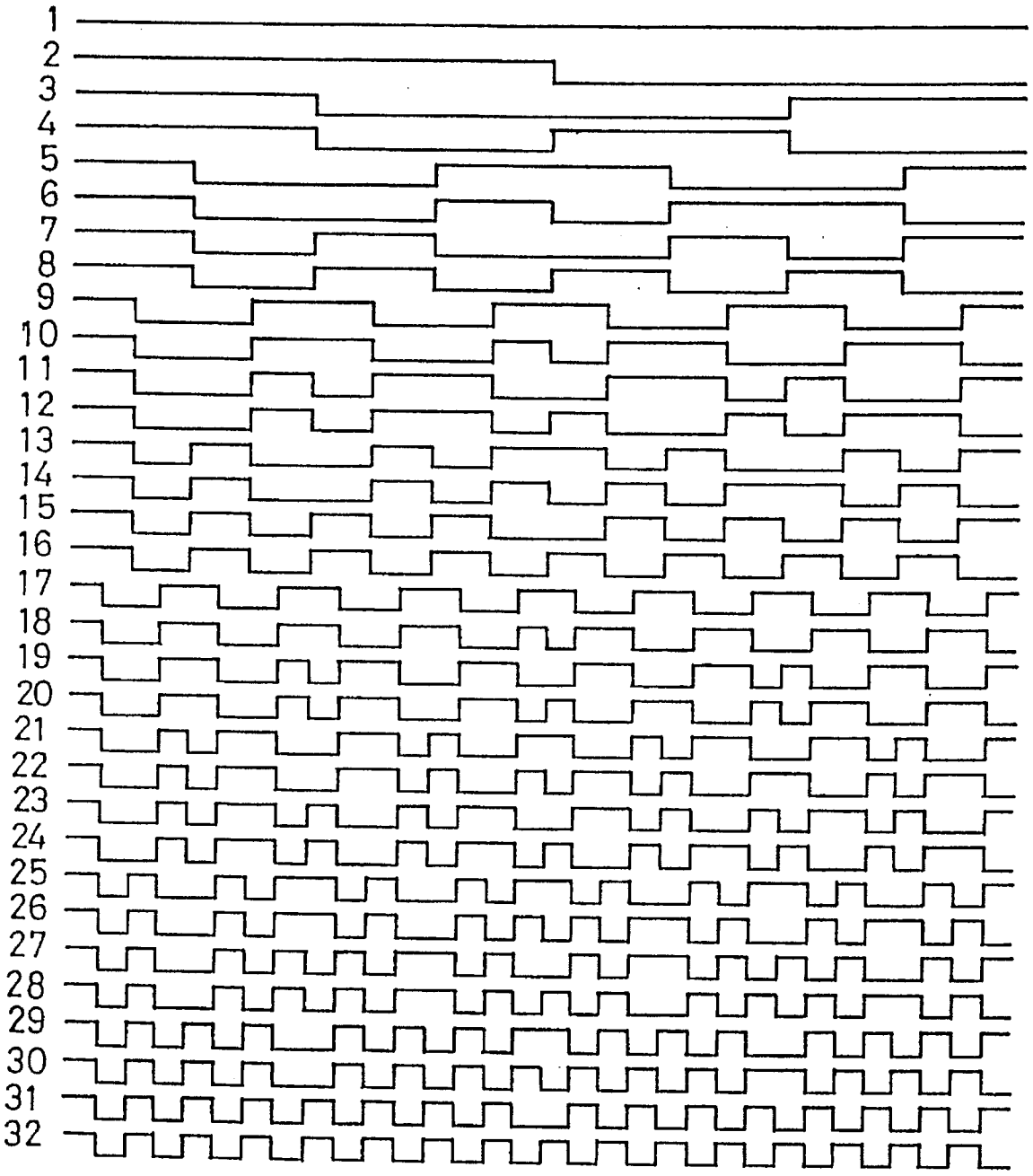
FIG. 5 is a waveform chart showing an example of the orthonormal functions.

FIG. 5 shows waveforms of Walsh functions. In the case of the concurrent seven-lines selection, technique for example, seven walsh functions of the second to eighth orders may be utilized to form the set of the row signals. As understood from comparison between FIG. 2 and FIG. 5, for instance, the row signal $F_1(t)$ corresponds to the Walsh function 2 of the second order of FIG. 5. The function has a high level in a first half of one period and a low level in a second half of one period. Accordingly, the signal $F_1(t)$ is composed of pulses in the sequence of (1,1,1,1,0,0,0,0). In similar manner, the signal $F_2(t)$ corresponds to the third order walsh function so that the pulses are arranged in the sequence of (1,1,0,0,0,0,1,1). Further, the signal $F_3(t)$ corresponds to the fourth order Walsh function so that the pulses are arranged in the sequence of (1,1,0,0,1,1,0,0). As understood from the above description, the set of the row signals concurrently applied to one group of the row electrodes are represented by an adequate combination pattern based on an orthonormal relationship. In the FIG. 2 case, the second group receives the set of the orthonormal signals $F_8(t)$–$F_{14}(t)$ having the same combination pattern. In similar manner, the third and further groups are applied with the set of the row signals corresponding to the same combination pattern.

Figure 6:
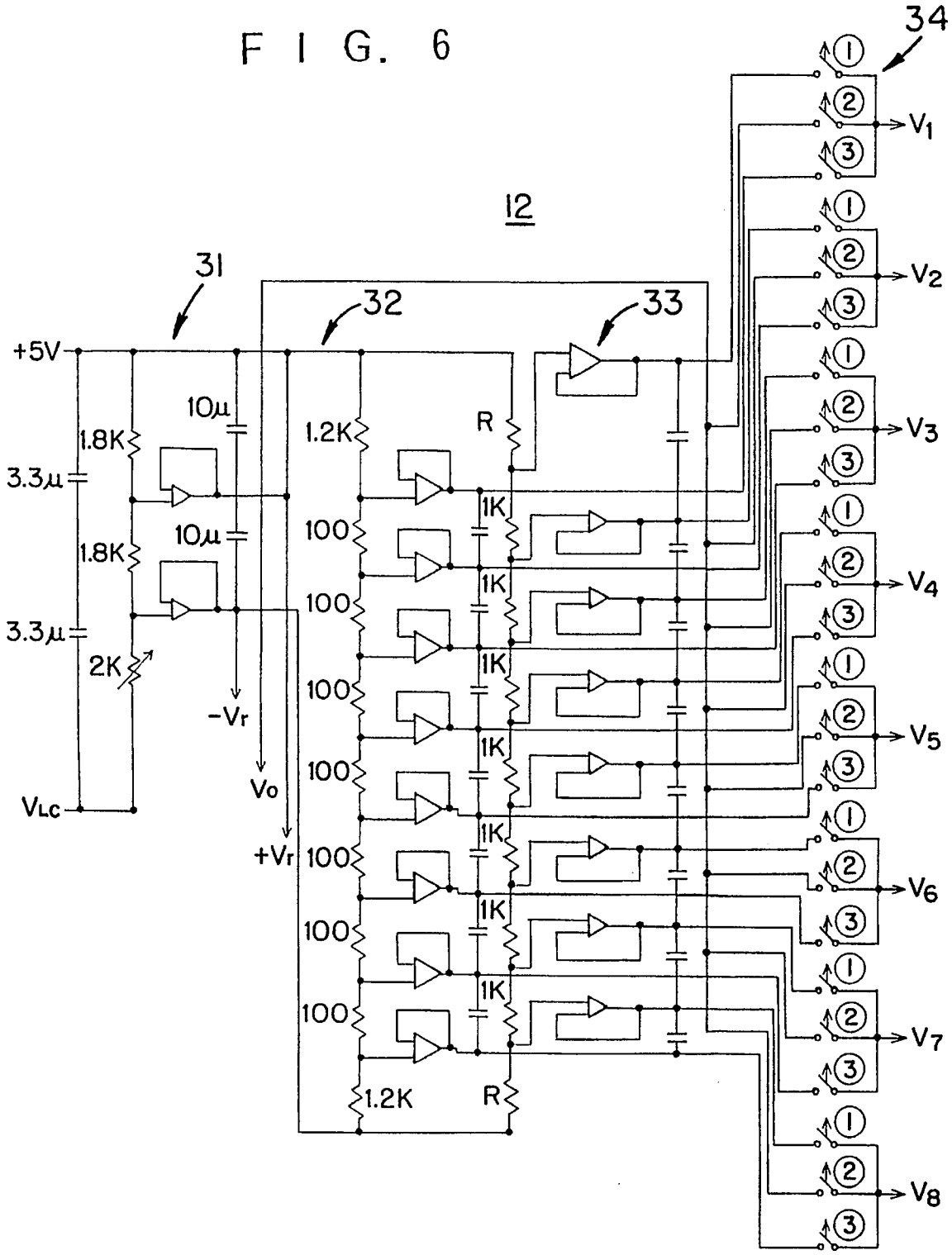
FIG. 6 is a circuit diagram showing a structural example of the voltage level circuit included in the device for driving a liquid crystal display panel shown in FIG. 1.

Finally, FIG. 6 is a circuit diagram showing a concrete structural example of the voltage level circuit 12 shown in FIG. 1. As mentioned above, the voltage level circuit 12 supplies eight voltage levels $V_1$ to $V_8$ necessary to generate the column signals and also performs a predetermined switching operation to lower the respective voltage levels to the reference potential. This switching operation is in synchronization with timing of applying the column signal components and is switched and controlled by a clock signal that is supplied from the drive controlling circuit 11 shown in, for instance, FIG. 1. As shown in FIG. 6, the voltage level circuit 12 has a front voltage dividing portion 31. This front voltage dividing portion 31 has two voltage dividing units each of which is composed of a resistor, a condenser and an operation amplifier, and divides a predetermined power source voltage according to a resistance ratio to obtain three voltage levels −Vr, Vo, and +Vr. These voltage levels are supplied to the vertical driver 4 shown in FIG. 1 and used to synthesize a waveform of the row signal. The voltage level circuit 12 includes a middle voltage dividing portion 32, which includes eight voltage dividing units that are connected in series between +Vr and −Vr. The respective voltage dividing units output the eight voltage levels $V_1$ to $V_8$ that are equally divided. The voltage level circuit 12 further includes a rear voltage dividing portion 33, which includes eight voltage dividing units similarly to the middle voltage dividing unit 32. The respective voltage dividing units output eight voltage levels for controlling charge and discharge. Finally, eight switches with three terminals 34 each, collectively denoted by reference numeral are provided according to the respective voltage dividing units. The respective switches each with three terminals output eight voltage levels, respectively to be supplied to the horizontal driver 5 shown in FIG. 1. The first input terminals ① of the respective switches with three terminals are supplied with the voltage level that is output from the voltage dividing unit corresponding to the rear voltage dividing portion 33. Further, the second input terminals ② are commonly supplied with a reference potential $V_0$ that is output from the front voltage dividing portion 31. Further, the third input terminals ③ are supplied with the voltage level that is output from the voltage dividing unit corresponding to the middle voltage dividing portion 32. Opening and closing of these input terminals ①, ② and ③ is controlled in accordance with predetermined control signals, and eight voltage levels $V_1$ to $V_8$ that have been once lowered to the reference potential can be obtained. In order to facilitate understanding, the control signals applied to the respective input terminals are represented by corresponding circled numbers.

Figure 7:
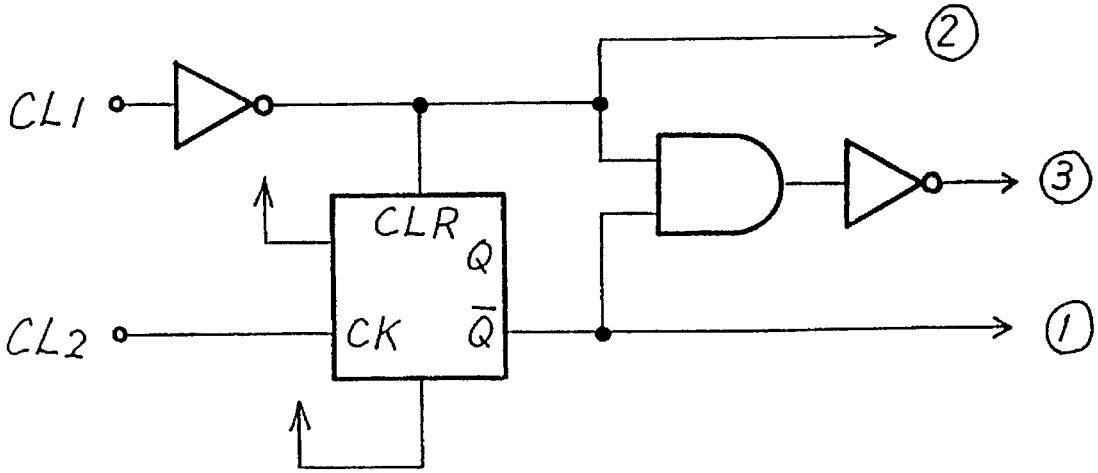
FIG. 7 is a circuit diagram showing an example of the pulse circuit used for controlling the voltage level circuit shown in FIG. 6.

FIG. 7 shows an example of a pulse circuit for supplying the control signals ①, ② and ③. This pulse circuit includes a flip flop, an AND gate with two terminals and two inverters. The pulse circuit generates desired control signals ①, ② and ③ according to clock signals CL1 and CL2 that are supplied from the drive controlling circuit 11 shown in FIG. 1.

Figure 8:
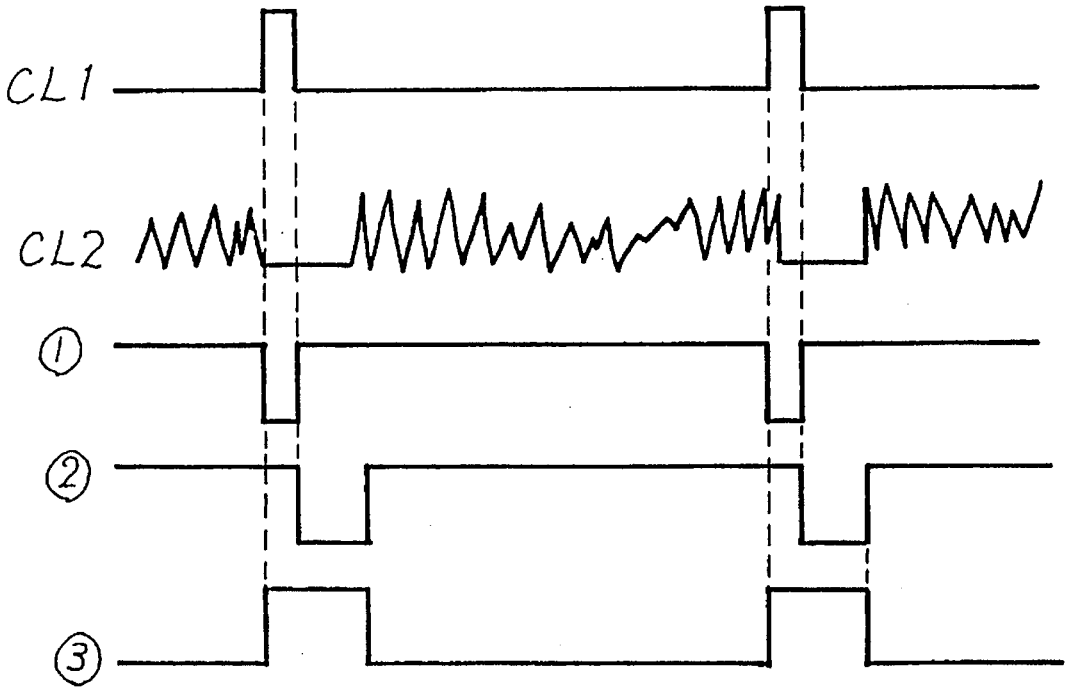
FIG. 8 is a waveform chart used to explain an operation of the pulse circuit shown in FIG. 7.

FIG. 8 is a waveform chart used to explain operation of the pulse circuit shown in FIG. 7. As shown in FIG. 8, synchronization pulse are generated at predetermined periodic intervals in the clock signal CL1. Synchronization pulse are also generated at predetermined periodic intervals in the clock signal CL2. The control signals ① are obtained by processing a pair of the clocks CL1 and CL2 with the flip flop shown in FIG. 7. The control signals ① include a pulse of negative polarity generated instantaneously in synchronization with the clock signals. The switches with three terminals shown in FIG. 6 are each of the low-active type, and the first input terminals ① are instantaneously energized in response to the negative pulses. As a result, the respective lines are charged and discharged. Then, the control signals ② generate negative pulse, and the second input terminals ② of the respective switches are energized. As a result, the respective lines are once connected with the reference potential $V_0$. Then, a level of the control signals ③ become low, and the third input terminals ③ are closed. As a result, the respective lines are supplied with eight voltage levels $V_1$ to $V_8$ that are output from the middle voltage dividing portion 32.

As mentioned above, according to the first feature of the present invention, the column signal components are arranged in an order from the column signal components corresponding to a more significant bit with a large pulse width to those corresponding to a less significant bit with a small pulse width to compose a column signal during one selecting period. Then, the column signal is applied to the group of column electrodes to drive the liquid crystal panel by Multiple Line Section. This brings about an effect that fluctuation in display density of each pixel can be restrained when half tone is displayed by Pulse Width Modulation. Moreover, according to the second feature of the present invention, the voltage level is once lowered to the predetermined potential between the column signal components before the column signal is applied to the group of column electrodes. This operation brings about effects that distortion in voltage waveform of the column signal can be restrained, and that fluctuation in display density of each pixel can be restrained.

What is claimed is:

1. A driving device for driving, according to predetermined pixel data, a liquid crystal display panel having a plurality of pixels arranged in a matrix, the display panel comprising a liquid crystal layer interposed between a group of row electrodes and a group of column electrodes, the driving device comprising: first means for applying a plurality of row signals represented by a set of orthonormal functions to the group of row electrodes by set sequential scanning for each of a plurality of selecting periods; and second means for sequentially performing a dot product computation between the set of orthonormal functions and a set of pixel data, generating a column signal having a voltage level corresponding to a result of the computation, and applying the column signal to each of the group of column electrodes in synchronization with the set sequential scanning for each of the selecting periods; wherein the second means comprises a frame memory for storing pixel data with gray shading represented by a plurality of data bits, dot product computing means for dividing the set of pixel data into the respective data bits and performing the computation to generate a column signal having a plurality of components each component corresponding to a respective bit, and driving means for arranging column signal components in a descending order from a column signal component of a most significant bit, having a first pulse width, to column signal component of a least significant bit, having a pulse width smaller than the first and all intermediate pulse widths during each of the selecting periods to form the column signal and for applying the column signal to the group of column electrodes.

2. A driving device for driving, according to predetermined pixel data, a liquid crystal display panel having a plurality of pixels arranged in a matrix, the display panel comprising a liquid crystal layer interposed between a group of row electrodes and a group of column electrodes, the driving device comprising: first means for applying a plurality of row signals represented by a set of orthonormal functions to the group of row electrodes by set sequential scanning for each of a plurality of selecting periods; and second means for sequentially performing a dot product computation between the set of orthonormal functions and a set of pixel data, generating a column signal having a voltage level corresponding to a result of the computation, and applying the column signal to each of the group of column electrodes in synchronization with the set sequential scanning for each of the selecting periods; wherein the second means comprises a frame memory for storing pixel data with gray shading represented by a plurality of data bits, dot product computing means for dividing the set of pixel data into the respective data bits and performing the computation to generate a column signal having a plurality of components each component corresponding to a respective bit, and driving means for arranging column signal components in accordance with bit significance during each of the plurality of selecting periods to form the column signal, reducing a voltage level between the column signal components by reducing the voltage of the components to a predetermined reference potential, and applying the column signal to the group of column electrodes.

3. A display device comprising: a plurality of first electrodes; a plurality of second electrodes opposing the first electrodes; a plurality of display elements electrically connected to the plurality of first and second electrodes and arranged in a matrix; selecting means for applying selecting signals to the first electrodes; processing means for performing an arithmetic operation between the selecting signals and a set of image data having a plurality of data bits representative of gray shading by dividing the image data into the respective data bits and performing the arithmetic operation between the respective data bits and the selecting signals to generate output signals having a plurality of components each corresponding to a respective data bit; and driving means for arranging the output signal components in descending order from a most significant output signal component having a first pulse width to a least significant output signal component having a second pulse width smaller than the first pulse width and applying the output signals to the second electrodes.

4. A display device according to claim 3; wherein the plurality of first and second electrodes are opposed from each other and the display elements comprise liquid crystal material elements interposed between the plurality of first electrodes and the plurality of second electrodes.

5. A display device according to claim 3; wherein the selecting means comprises orthonormal signal generating means for generating a plurality of orthonormal signals for simultaneously selecting a multiple number of the plurality of first electrodes.

6. A display device according to claim 3; wherein the processing means comprises dot product computation means for performing a dot product between the image data and the selecting signals.

7. A display device according to claim 3; further comprising a frame memory for storing the image data; and the processing means includes means for reading the image data from the frame memory.

8. A display device according to claim 7; further comprising synchronizing means for synchronizing operation of the processing means and the selecting means such that the reading of image data from the frame memory and the application of selecting signals to the first electrodes is conducted on a synchronized basis.

9. A display device according to claim 3; wherein the respective first electrodes are mutually orthogonal with respect to the respective second electrodes; the display elements comprise liquid crystal material elements interposed between the respective first and second electrodes; and the selecting means comprises orthonormal function generating means for applying a group of orthonormal functions to a multiple number of the first electrodes to simultaneously select multiple first electrodes.

10. A display device according to claim 9; wherein the processing means comprises means for sequentially performing a dot product computation between the set of orthonormal functions and the image data, generating output signals each having a voltage level corresponding to a result of the computation, and applying the output signals to the respective second electrodes in synchronization with the application of orthonormal signals to the first electrodes.

11. A display device according to claim 10; wherein the processing means further comprises a frame memory for storing a set of image data having a plurality of data bits representative of gray shading and dot product computing means for dividing the set of image data into the respective data bits and performing the computation to generate an output signal having a plurality of components each corresponding to a respective bit.

12. A display device comprising: a plurality of first electrodes; a plurality of second electrodes opposing the first electrodes; a plurality of display elements electrically connected to the plurality of first and second electrodes and arranged in a matrix; selecting means for applying selecting signals to the first electrodes; processing means for performing an arithmetic operation between the selecting signals and a set of image data having a plurality of data bits representative of gray shading by dividing the image data into the respective data bits and performing the arithmetic operation between the respective data bits and the selecting signals to generate output signals having a plurality of components each corresponding to a respective data bit; and driving means for reducing a voltage level between the output signal components by reducing the voltage of the respective components to a predetermined reference potential, and applying the column signal to the group of column electrodes.

13. A display device according to claim 12; wherein the plurality of first and second electrodes are opposed from each other and the display elements comprise liquid crystal material elements interposed between the plurality of first electrodes and the plurality of second electrodes.

14. A display device according to claim 12; wherein the selecting means comprises orthonormal signal generating means for generating a plurality of orthonormal signals for simultaneously selecting a multiple number of the plurality of first electrodes.

15. A display device according to claim 12; wherein the processing means comprises dot product computation means for performing a dot product between the image data and the selecting signals.

16. A display device according to claim 12; further comprising a frame memory for storing the image data; and the processing means includes means for reading the image data from the frame memory.

17. A display device according to claim 16; further comprising synchronizing means for synchronizing operation of the processing means and the selecting means such that the reading of image data from the frame memory and the application of selecting signals to the first electrodes is conducted on a synchronized basis.

18. A display device according to claim 12; wherein the respective first electrodes are mutually orthogonal with respect to the respective second electrodes; the display elements comprise liquid crystal material elements interposed between the respective first and second electrodes; and the selecting means comprises orthonormal function generating means for applying a group of orthonormal functions to a multiple number of the first electrodes to simultaneously select multiple first electrodes.

19. A display device according to claim 18; wherein the processing means comprises means for sequentially performing a dot product computation between the set of orthonormal functions and the image data, generating output signals each having a voltage level corresponding to a result of the computation, and applying the output signals to the respective second electrodes in synchronization with the application of orthonormal signals to the first electrodes.

20. A display device according to claim 19; wherein the processing means further comprises a frame memory for storing a set of image data with gray shading represented by a plurality of data bits, and dot product computing means for dividing the set of image data into the respective data bits and performing the computation to generate an output signal having a plurality of components each component corresponding to a respective bit.

* * * * *